US009518448B2

(12) United States Patent
Read

(10) Patent No.: US 9,518,448 B2
(45) Date of Patent: Dec. 13, 2016

(54) APPARATUS AND METHOD FOR GENERATING POWER DOWNHOLE AND USING SAME FOR PERFORMING A DOWNHOLE OPERATION

(71) Applicant: Ellen E. Read, Houston, TX (US)

(72) Inventor: Ellen E. Read, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 562 days.

(21) Appl. No.: 13/839,389

(22) Filed: Mar. 15, 2013

(65) Prior Publication Data

US 2014/0262218 A1 Sep. 18, 2014

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
See application file for complete search history.

(56) References Cited

U.S. PATENT DOCUMENTS 3,342,267 A * 9/1967 Cotter ..... E21B 36/04 166/60
7,165,608 B2 * 1/2007 Schultz ..... E21B 41/0085 166/66.5
2002/0121377 A1 * 9/2002 Longbottom ..... 166/372
2002/0124652 A1 * 9/2002 Schultz et al. ..... 73/587
2002/0148646 A1 * 10/2002 Schultz et al. ..... 175/40
2003/0043055 A1 * 3/2003 Schultz et al. ..... 340/856.3
2003/0131986 A1 * 7/2003 Schultz et al. ..... 166/66.5
2004/0140726 A1 * 7/2004 Spring ..... 310/166
2005/0012340 A1 * 1/2005 Cousins ..... 290/52
2005/0024231 A1 * 2/2005 Fincher et al. ..... 340/854.4
2005/0051323 A1 * 3/2005 Fripp et al. ..... 166/65.1
2005/0207279 A1 * 9/2005 Chemali et al. ..... 367/83
2005/0230973 A1 * 10/2005 Fripp et al. ..... 290/1 R
2005/0230974 A1 * 10/2005 Masters et al. ..... 290/1 R
2006/0086498 A1 * 4/2006 Wetzel et al. ..... 166/250.12
2006/0175838 A1 * 8/2006 Tips ..... 290/1 R
2007/0194948 A1 * 8/2007 Hall et al. ..... 340/854.8
2008/0047753 A1 * 2/2008 Hall et al. ..... 175/57
2008/0277941 A1 * 11/2008 Bowles et al. ..... 290/54
2009/0079199 A1 * 3/2009 Tubel ..... 290/1 A
2009/0134631 A1 * 5/2009 Guerrero et al. ..... 290/1 R
2010/0133833 A1 * 6/2010 Williams ..... 290/50
2010/0308599 A1 * 12/2010 Pabon et al. ..... 290/1 A
2011/0057449 A1 * 3/2011 Marya et al. ..... 290/54
2011/0133465 A1 * 6/2011 Drevt ..... 290/54
2012/0067567 A1 * 3/2012 Rytlewski et al. ..... 166/250.01
2012/0103690 A1 * 5/2012 Patel et al. ..... 175/57

OTHER PUBLICATIONS

Schlumberger Oilfield Glossary entry for "slips", accessed Aug. 4, 2016 via www.glossary.oilfield.slb.com.*

* cited by examiner

*Primary Examiner* — Blake Michener
(74) *Attorney, Agent, or Firm* — Cantor Colburn LLP

(57) ABSTRACT

A wellbore system is disclosed. The wellbore system includes a coil in the wellbore, a magnetic element conveyed from a surface location that is configured to oscillate or rotate in an opening in the coil to generate electrical energy, and a device in the wellbore that utilizes the generated electrical energy.

18 Claims, 3 Drawing Sheets

APPARATUS AND METHOD FOR GENERATING POWER DOWNHOLE AND USING SAME FOR PERFORMING A DOWNHOLE OPERATION

BACKGROUND

1. Field of the Disclosure

This disclosure relates generally to wellbore operations, including generating electrical energy downhole and performing a downhole operation.

2. Brief Description of the Related Art

Oil wells (wellbores) are drilled to a selected depth in earth formations for the production of hydrocarbons. The wellbore is often lined with a casing. Perforations are made proximate production zones to flow the fluid from the formation into the casing. A production string containing flow control devices is placed inside the casing to flow the fluid to a surface location. In certain formations, fluid from the surface is supplied to the production zones to fracture the formation to enable the fluid from the formation to flow into the wellbore. Sensors and other electrically-operated devices are used to provide information about various downhole parameters and to perform one or more operations downhole. The production wells typically, do not have high fluid rates that can be used to generate electrical energy downhole. It is desirable to generate electrical energy that can be utilized to operate sensors and other devices downhole.

The disclosure herein provides a wellbore system in which electrical energy is generated and utilized to operate one or more devices downhole.

SUMMARY

In one aspect, a wellbore system is disclosed that in one embodiment may include an inductive coil in the wellbore, a magnetic element conveyed from a surface location configured to oscillate in an opening in the coil to generate electrical energy, and a device in the wellbore that utilizes the generated electrical energy. In another aspect, the magnetic element may be oscillated by a device conveyed in the wellbore.

In another aspect, a method of performing an operation in a wellbore is disclosed that in one embodiment may include: placing an inductive coil in the wellbore, the coil having an opening; conveying a magnetic element into the opening of the coil; and moving the magnetic member in the opening of the coil to generate electrical energy in the coil.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings, wherein like elements generally are designed with like numerals.

DESCRIPTION OF THE DRAWINGS

Figure 1:
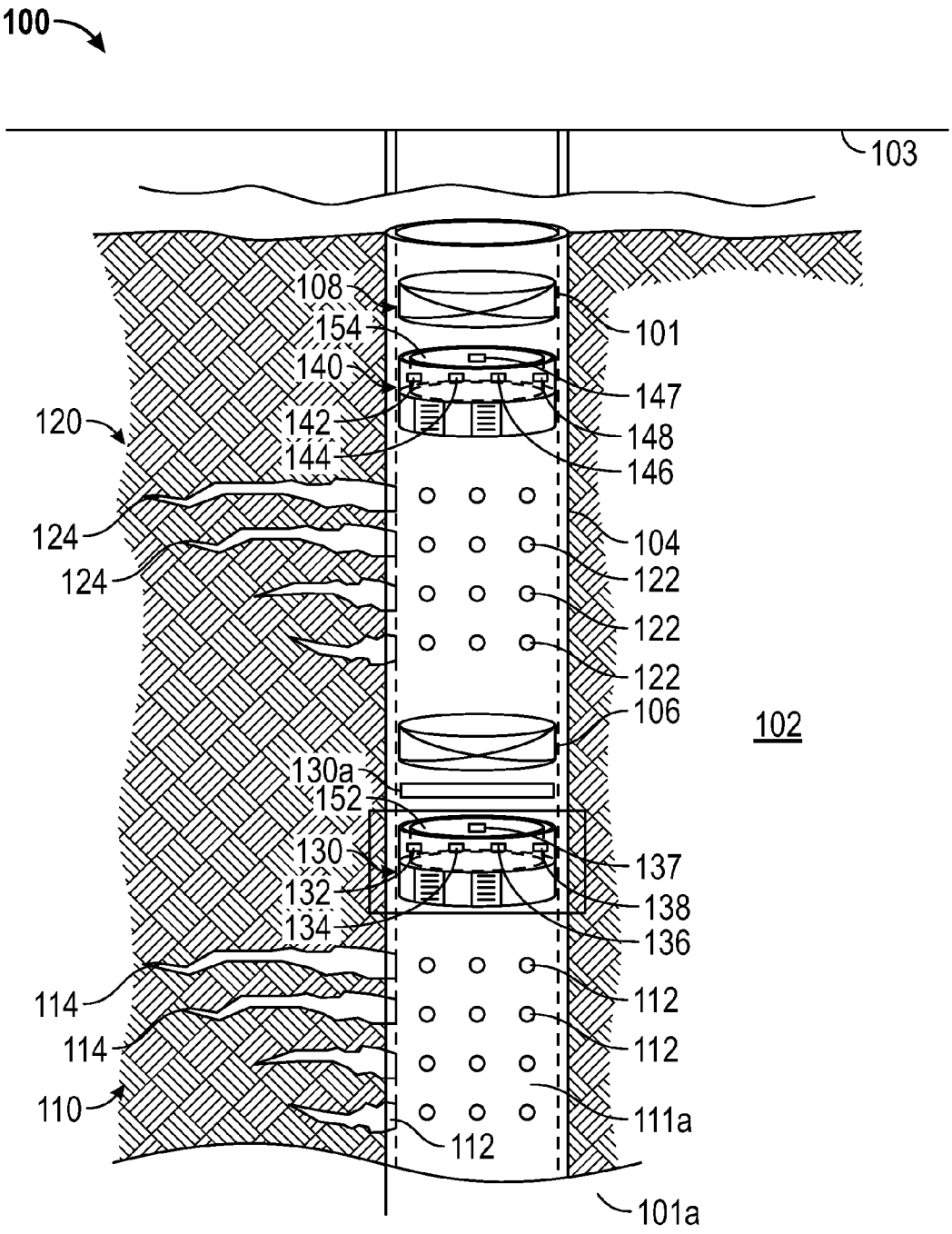
FIG. 1 is a schematic diagram of an exemplary wellbore or well system configured to generate electrical energy downhole and utilize such generated electrical energy to operate a device downhole, according to one embodiment of the disclosure.

FIG. 1 is a schematic diagram of an exemplary wellbore or well system 100 according to one embodiment of the disclosure. The wellbore system 100 includes a wellbore 101 formed in a formation 102 from a surface location 103. The wellbore 101 is lined with a casing 104 to a certain wellbore depth 101*a*. The casing 104 may be made by joining metallic pipe sections. In one aspect, wellbore 101 may include a number of production zones. In the particular configuration of system 100 shown in FIG. 1, the wellbore 101 includes a lower production zone 110 and an upper production zone 120. The lower and upper production zones 110 and 120 are isolated by an isolation device 106, such as packer. An isolation device 108 isolates the upper production zone from the wellbore above the production zone 120. The lower production zone 110 includes perforations 114 that extend from perforations 112 in the casing section 110 into the formation 102. The perforations 114 provide fluid communication between the formation 102 and the inside 111*a* of the casing 110 at the lower production zone 110. Similarly, the upper production zone 120 includes perforations 124 that extend from the perforations 122 in the casing section 110 adjacent the upper production zone 120.

In one aspect, the wellbore 101 contains a sensor-coil unit 130 placed in or above (uphole) the lower production zone 110. In one aspect, the sensor-coil unit 130 includes an inductive coil 132, one or more sensors 134, an electrical power unit 136, such as a rechargeable battery, a control circuit 137 and a data transmission or communication circuit or device 138. Similarly, a sensor-coil unit 140 is placed uphole in or of the production zone 120 that may include a coil 142, one or more sensors 144, a power unit 146, a control circuit 147 and a data transmission or communication device 148. The sensor-coil unit 130 has an opening 152 through which a device may be passed. Similarly, the sensor-coil unit 140 includes an opening or passage 154. Sensors, 134 and 144 may include any suitable sensors for providing signals relating to one or more downhole parameters, including, but not limited to, pressure, temperature, water ingress, and fluid flow rate. The data communication units (138, 148) may include any device, including, but not limited to, an electromagnetic device, an acoustic device, an optical device and a pulser that generates pressure pulsed in the fluid in the wellbore. The sensor-coil unit (130, 140) may be secured inside the wellbore by any suitable mechanism, including, but not limited to, grapples and wickered slips.

Figure 2:
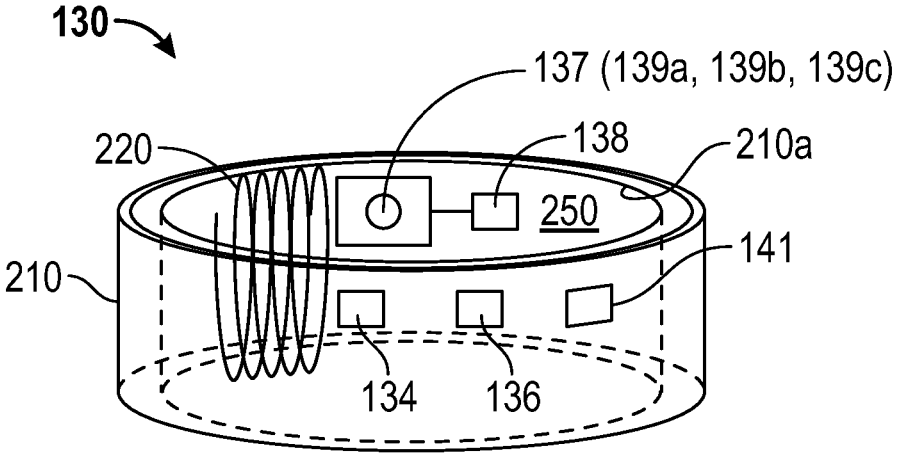
FIG. 2 shows certain details of a sensor-coil unit for producing electrical energy in the wellbore shown in FIG. 1.

FIG. 2 shows certain details of a sensor-coil unit 130. In one aspect, the sensor-coil unit 130 may include a non-conductive housing 210 having a passage 250 therethrough. A coil 220 is wound around an inside 212 of the housing 210. In one aspect, the coil 220 may be wound around the entire inner side of the housing 210 so that it surrounds an inner section of the casing 110, with the passage 250 therethrough. Alternatively, the coil 220 may be wound in discrete electrically connected sections. Sensors 134, power unit 136 and control circuit 137 and communication unit 138 are shown placed around the inside 210*a* of the housing 210. In one aspect, the coil 220 is coupled to the power unit 136, which is electrically coupled to the sensors 134, the control unit 137 and communication device 137. The control unit 137 is coupled to the sensors 134 for receiving measurements therefrom. In one aspect, the control unit 137 may include circuits to amplify, filter and digitize the sensor signals and provide such signals to the communication unit 138 for transmitting such signals to a receiving unit at the surface as described in reference to FIG. 3. In another aspect, the control unit 137 may also include one or more processors 139*a*, data storage device 139*b* and programmed instructions 139*c* accessible to the processor for executing such instruction. In another aspect, the control unit 137 may control an operation of a downhole device in response to the sensor measurements as described in reference to FIG. 3. The sensor-coil unit 140 may include components as described in reference to FIG. 3. In another embodiment, sensors 134, power unit 136, control circuit 137 and communication unit 138 may be placed outside the coil 132, such as a location 130*a* proximate the coil 132. Similarly, sensors 144, power unit 146, control circuit 147 and data communication unit 148 may be placed outside the coil 142, such as a location 120*a* proximate coil 142.

Figure 3:
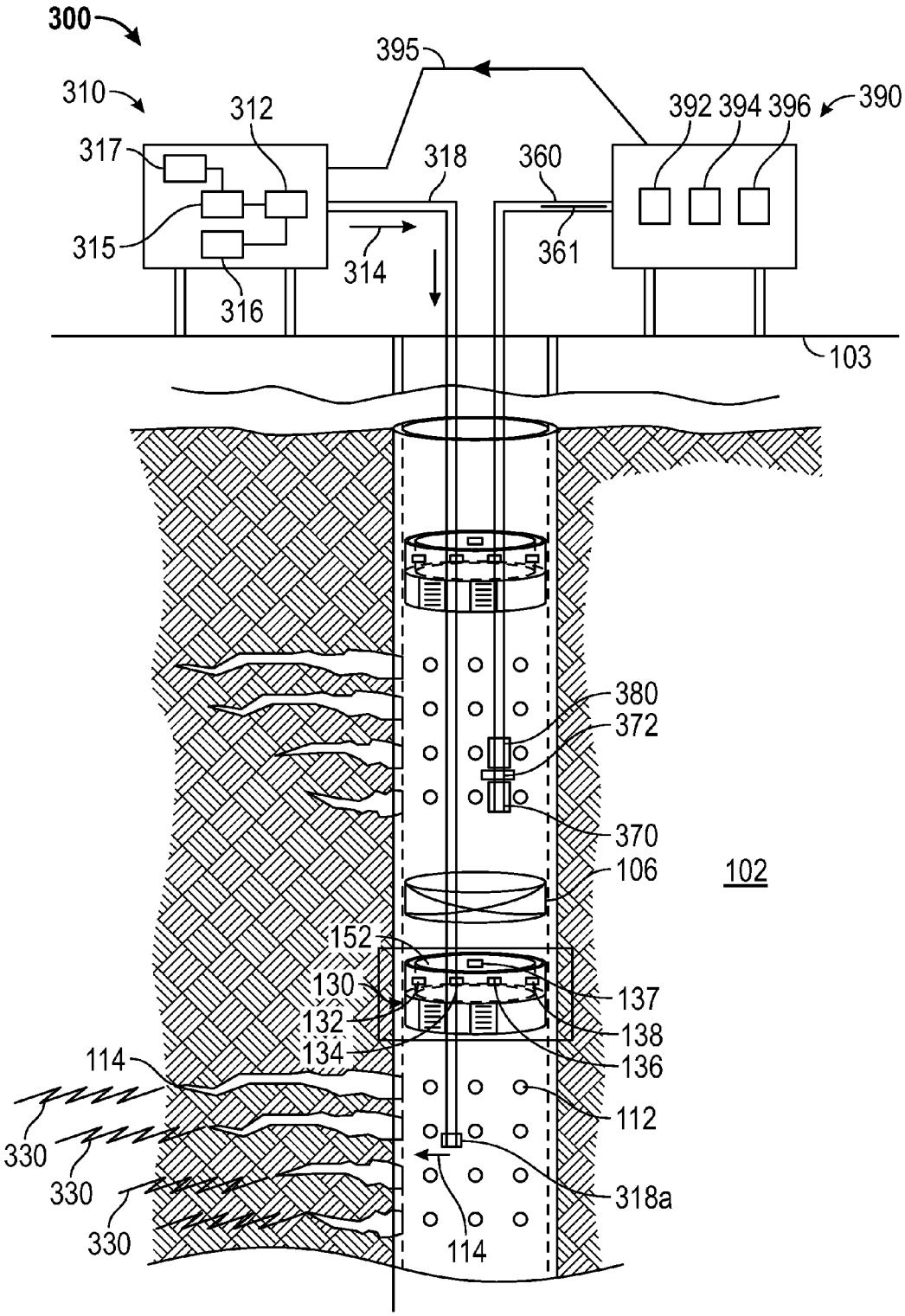
FIG. 3 shows a schematic diagram of the wellbore system of FIG. 1 showing performance of a fracturing operation in the wellbore, according to one embodiment of the disclosure.

FIG. 3 shows a schematic diagram of a wellbore system 300 showing performance of a fracturing operation of the lower production zone 110 of the wellbore 101 shown in FIG. 1, according to one embodiment of the disclosure. The wellbore system 300 includes a fluid pumping unit 310 that includes a pump 312 that pumps a fluid 314 from a storage unit 316 into a coiled tubing 318 deployed in the wellbore 101. The fluid 314 discharges into the lower production zone 110 at location 318*a* and flows into the formation 102 through perforations 114, causing the fractures 330 to occur. A controller 317 controls a motor 315 to operate the pump 312. The wellbore system 300 further includes a unit 350, which may be a wireline unit, having a conveying member 360, such as a wireline or coiled tubing, conveyed into the wellbore 101. A magnetic element 370, such as an electromagnet or a permanent magnet, is placed proximate the bottom end of the conveying member 360. A receiver or data acquisition unit 380 also is shown placed proximate the bottom end of the conveying member 360. The data acquisition unit 380 is compatible with the data transmission device 138 and may include, but is not limited to, an electromagnetic receiver, an acoustic transducer and optical unit. If a pulser is used to transmit pressure pulses in the fluid in the wellbore 101, such pulses may be received by a receiver (such as a pressure sensor in the unit 380 or transmitted directly to a sensor at the surface. Power to the data acquisition device 380 may be supplied from the unit 350 via a power line or conductor 361 in the conveying member 360. The unit 350 also contains a surface control unit 390, which, in one aspect, may be a computer based system and may include a processor 392, such a microprocessor, a data storage device 394, such as a memory device, and programs 196 accessible to the processor 392 for executing instructions contained in the programs 396. In one aspect, the control unit 390 is configured to control the operation of one or more surface devices, including the operation of the fluid pumping unit 310 via a communication link 395.

In one aspect, the conveying member 360 is deployed in the wellbore 101 to locate the magnetic element 370 in the coil 132. The conveying member 360 is moved up and down (oscillated) or rotated, which causes electrical current to flow through the coil 132. The electrical current from the coil 132 charges the power unit 136, which supplies electrical energy to the sensors 134. Alternatively, the magnetic element 370 may be coupled to an oscillating device 372 that oscillates when electrical energy is supplied thereto from the surface, which causes the magnetic element 370 to oscillate inside the coil 132. Thus, in one aspect, the coil 132 in the wellbore and the magnetic member 370 conveyed from the surface produce electrical energy downhole, which energy is supplied to one or more devices downhole. Although, sensors 134 are shown as the downhole devices being powered by the downhole generated electrical energy, any other device, such as a valve 141 or sliding sleeve may be supplied with such downhole generated energy.

To perform a fracturing operation in the wellbore 101, fluid 314 is pumped from the surface 103. The sensors 114 measure selected parameters, such as pressure, temperature and flow rate, etc. of the fluid 314 in the wellbore proximate the production zone 110. The control circuit 137 processes the signals from the sensors 134 and the data transmission device 138 transmits the sensor data to the data acquisition device 380, which transmits the sensor data to the surface controller 390. The controller 390 determines values of one or more downhole parameters, such as pressure, temperature flow rate, and in response to one or more such downhole parameters controls the operation of the pumping unit 310. In FIG. 3, the power generation downhole, use of such power to operate one or more downhole devices, is illustrated in reference to sensors and further the control of a downhole operation in response to the sensor measurements is described in reference to a fracturing operation. However, it will be understood that the concepts described herein may be utilized for any downhole application, including, but not limited to, the control of fluid from a formation into the wellbore, operating one or more downhole devices, such as flow control devices, etc.

The foregoing disclosure is directed to the certain exemplary embodiments and methods. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. A wellbore system, comprising:

a housing that is secured within a casing in the wellbore via at least one slip;

an inductive coil in the housing;

a magnetic element conveyed from a surface location to a location of the inductive coil by a conveying member and is selectively movable in the inductive coil by a motion provided by the conveying member to generate electrical energy; and a device in the housing that utilizes the generated electrical energy.

2. The wellbore system of claim 1, wherein the inductive coil is attached on an inside of the housing and further includes a passage therethrough.

3. The wellbore system of claim 1, wherein the device includes a sensor that provides signals corresponding to a downhole parameter.

4. The wellbore system of claim 3 further comprising a controller that determines the downhole parameter from the sensor signals and controls a wellbore operation.

5. The apparatus of claim 4, wherein the operation is selected from a group consisting of: (i) fracturing; (ii) opening of a valve; and (iii) closing of a valve.

6. The wellbore system of claim 1 further comprising:

a data acquisition device carried by the conveying member; and a data transmission device in the wellbore configured to transmit data from the device to the data acquisition device.

7. The wellbore system of claim 1, wherein the magnetic element is movable in the inductive coil by one selected from the group consisting of: (i) motion of the conveying member; (ii) an oscillating device coupled to the magnetic element; and (iii) a rotating device coupled to the magnetic element.

8. The wellbore system of claim 1, wherein the device is a sensor that provides signals relating to a parameter of interest; and wherein the wellbore system further includes:

a data transmission device in the housing configured to transmit data relating to the parameter of interest; and a data receiver in the wellbore that receives the data transmitted by the data transmission device.

9. The wellbore system of claim 8 further comprising a controller that receives the data from the data receiver and controls a wellbore operation in response thereto.

10. A method of performing an operation in a wellbore, comprising:

placing a housing within a casing in the wellbore, the housing including an inductive coil having an opening;

securing the housing to the casing using at least one slip;

conveying a magnetic element by a conveying member from a surface location into the opening of the inductive coil; and using a motion provided by the conveying member to move the magnetic element in the opening of the inductive coil to generate electrical energy in the inductive coil.

11. The method of claim 10 further comprising:

providing a sensor in the housing; and providing the generated electrical energy to the sensor to generate signals relating to a parameter of interest.

12. The method of claim 11 further comprising:

determining from the sensor signals a value of the parameter of interest; and performing a wellbore operation at least in part based on the value of the parameter of interest.

13. The method of claim 12, wherein the wellbore operation is selected from a group consisting of: (i) fracturing; (ii) opening of a valve; and (iii) closing of a valve.

14. The method of claim 12, further comprising performing the wellbore operation at least in part based on the value of the parameter of interest at least in part by using a controller at a surface location.

15. The method of claim 11, wherein moving the magnetic element comprises one selected from the group consisting of: (i) rotating the magnetic element by rotating the conveying member; (ii) oscillating the magnetic element by oscillating the conveying member; (iii) oscillating the magnetic element using an oscillating device coupled to the magnetic element and to the conveying member.

16. The method of claim 11 further comprising:

providing a transmitter in the housing that transmits data relating to the measurements made by the sensor;

conveying a receiver in the wellbore on the conveying member, wherein the receiver receives the data from the transmitter; and processing the data received by the receiver to determine a value of a parameter of interest.

17. The method of claim 16 further comprising performing an operation based at least in part on the determined value of the parameter of interest.

18. The method of claim 17, wherein the operation is selected from a group consisting of: (i) fracturing; (ii) opening of a valve; and (iii) closing of a valve.

* * * * *